US007665489B1

(12) United States Patent
Smith

(10) Patent No.: US 7,665,489 B1
(45) Date of Patent: Feb. 23, 2010

(54) SANDBAG FILLING APPARATUS

(76) Inventor: Lonna L. Smith, P.O. Box 294, Galt, CA (US) 95632

( * ) Notice: Subject to any disclaimer, the term of this patent is extended or adjusted under 35 U.S.C. 154(b) by 104 days.

(21) Appl. No.: 11/754,645

(22) Filed: May 29, 2007

(51) Int. Cl.
*B65B 1/04* (2006.01)
*A01K 29/00* (2006.01)

(52) U.S. Cl. ..... 141/108; 141/10; 141/114; 141/314; 294/1.4; 294/1.5

(58) Field of Classification Search ..... 141/10, 141/108, 109, 114, 313, 314; 294/1.4, 1.5, 294/51, 55
See application file for complete search history.

(56) References Cited

U.S. PATENT DOCUMENTS

| | | | | | |
|---|---|---|---|---|---|
| 861,107 | A * | 7/1907 | Goggin | 172/372 |
| 3,659,888 | A * | 5/1972 | Dreier | 294/49 |
| 4,149,745 | A * | 4/1979 | Willis | 294/1.4 |
| 4,462,728 | A * | 7/1984 | Sturgis | 408/241 R |
| 4,794,667 | A * | 1/1989 | Nelson et al. | 16/426 |
| 5,031,277 | A * | 7/1991 | Coker | 15/257.3 |
| 5,031,948 | A * | 7/1991 | Groth et al. | 294/1.1 |
| D333,888 | S * | 3/1993 | Visser | D30/162 |
| 5,205,107 | A * | 4/1993 | Herink | 53/255 |
| 5,395,147 | A * | 3/1995 | Brown et al. | 294/55 |
| 5,575,315 | A | 11/1996 | Wengert | |
| 5,673,734 | A | 10/1997 | Hawley | |
| 5,951,079 | A | 9/1999 | Winskye | |
| 6,012,748 | A * | 1/2000 | Franks | 294/1.4 |
| D440,729 | S | 4/2001 | Piner et al. | |
| 6,237,973 | B1 | 5/2001 | Dupont et al. | |
| 6,378,577 | B1 * | 4/2002 | Piner et al. | 141/391 |
| 6,679,948 | B2 * | 1/2004 | Mead | 134/6 |
| 7,040,195 | B1 * | 5/2006 | Lackey et al. | 81/45 |
| 7,418,892 | B2 * | 9/2008 | Taylor | 81/177.1 |
| 2002/0008392 | A1 * | 1/2002 | Harrison | 294/1.4 |

* cited by examiner

*Primary Examiner*—Timothy L Maust

(57) ABSTRACT

A sandbag filling apparatus includes a head portion with a bottom wall having a front edge, a rear edge, a first side edge and a second side edge. A first side wall is attached to the first side edge. A second side wall is attached to the second side edge. A rear wall is attached to the first and second side walls. A fill opening is defined between the rear edge and the rear wall. An elongated member is attached to and extends away from the rear wall. A handle is attached to the elongated member opposite of the elongated member opposite of the head portion. A retaining apparatus is mounted on the head portion and releasably retains a sandbag in an open position and aligned with the fill opening. Sand may be scooped with the bottom wall and dumped into the sandbag through the fill opening.

6 Claims, 5 Drawing Sheets

SANDBAG FILLING APPARATUS

BACKGROUND OF THE INVENTION

1. Field of the Invention

The present invention relates to sandbag filling devices and more particularly pertains to a new sandbag filling device for assisting a person in quickly filing a sandbag with sand.

2. Description of the Prior Art

The use of sandbag filling devices is known in the prior art. While these devices fulfill their respective, particular objectives and requirements, the need remains for a device that allows a person to place sand in a sandbag quickly without having to first scoop the sand and then pour it into a bag being held by a second person. This will allow faster filling of bags and therefore quicker building of barrier walls.

SUMMARY OF THE INVENTION

The present invention meets the needs presented above by generally comprising a head portion that has a bottom wall including a front edge, a rear edge, a first side edge and a second side edge. A first side wall is attached to and extends upwardly from the first side edge. A second side wall is attached to and extends upwardly from the second side edge. The first and second side walls extend rearward of the rear edge. A rear wall is attached to and extends between distal ends of the first and second side walls with respect to the bottom wall. A fill opening is defined between the rear edge and the rear wall. An elongated member is attached to and extends away from the rear wall. A handle is attached to the elongated member opposite of the elongated member opposite of the head portion. A retaining apparatus is mounted on the head portion and releasably retains a sandbag in an open position and aligned with the fill opening. Sand may be scooped with the bottom wall and dumped into the sandbag through the fill opening.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
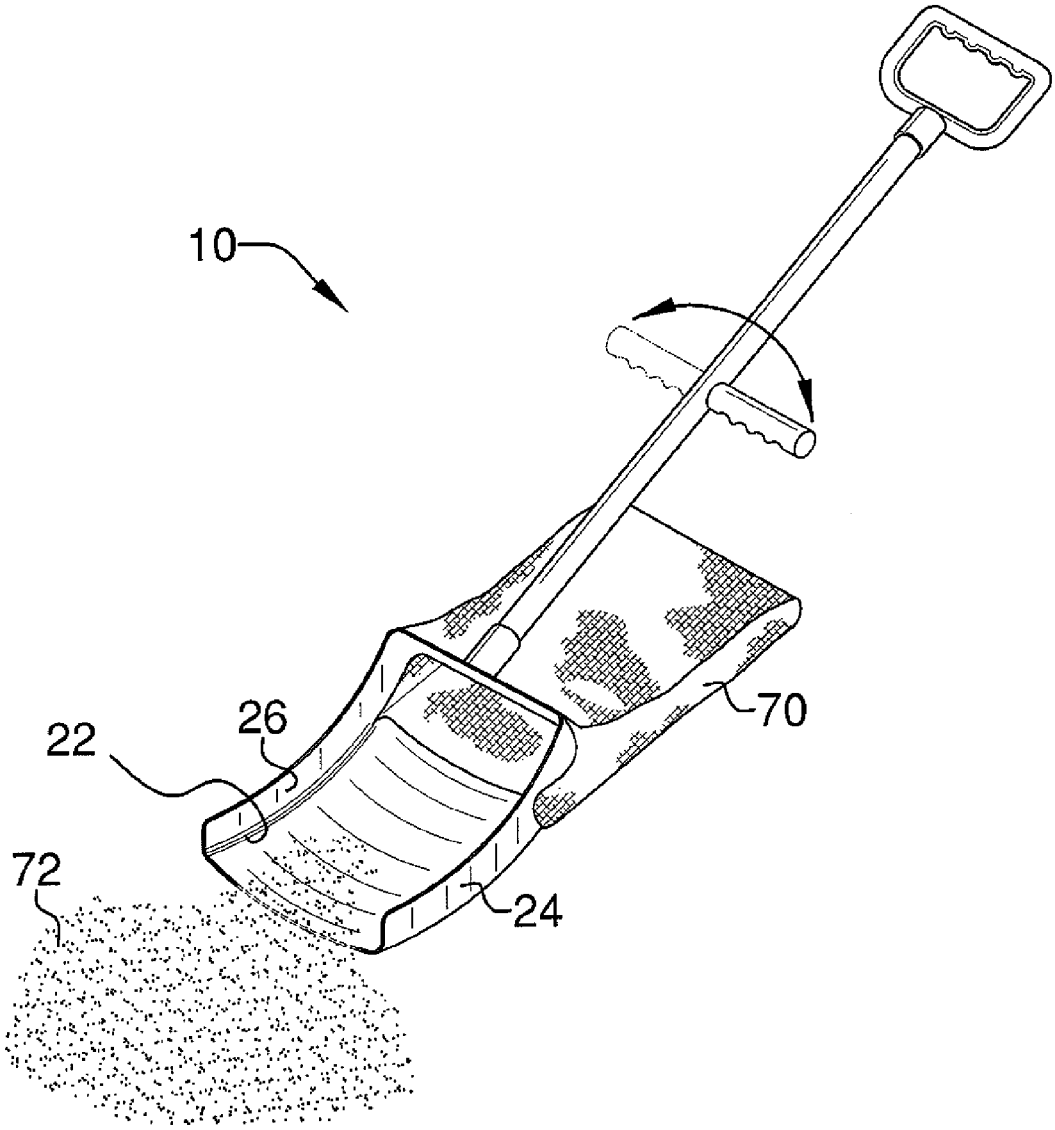
FIG. 1 is a perspective in-use view of a sandbag filling apparatus according to the present invention.
Figure 2:
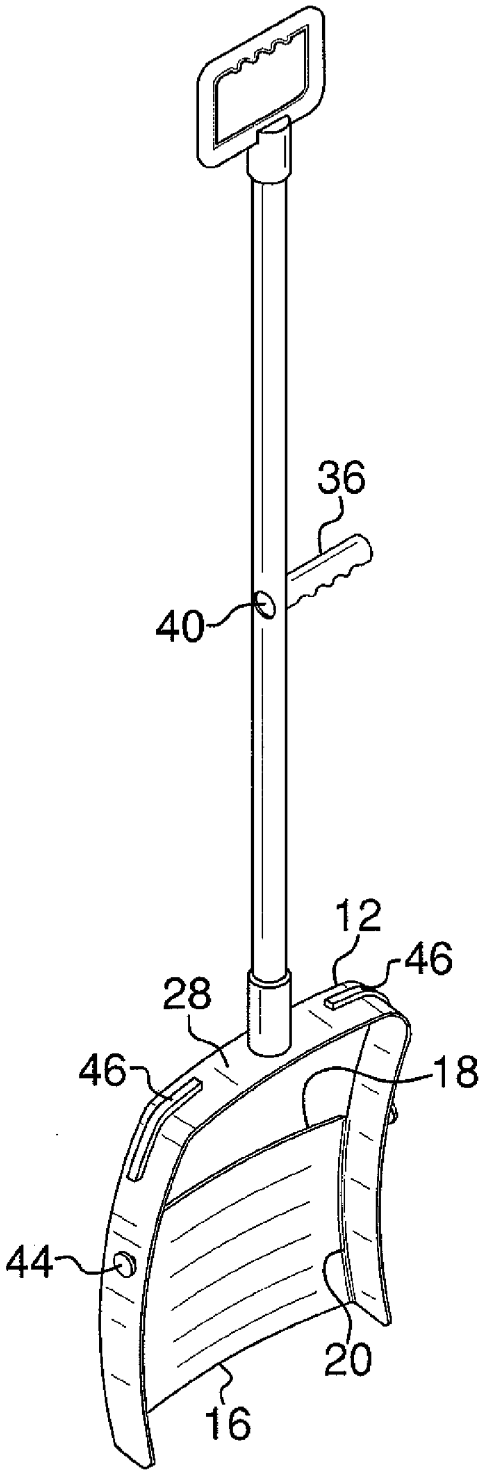
FIG. 2 is a perspective view of the present invention.
Figure 3:
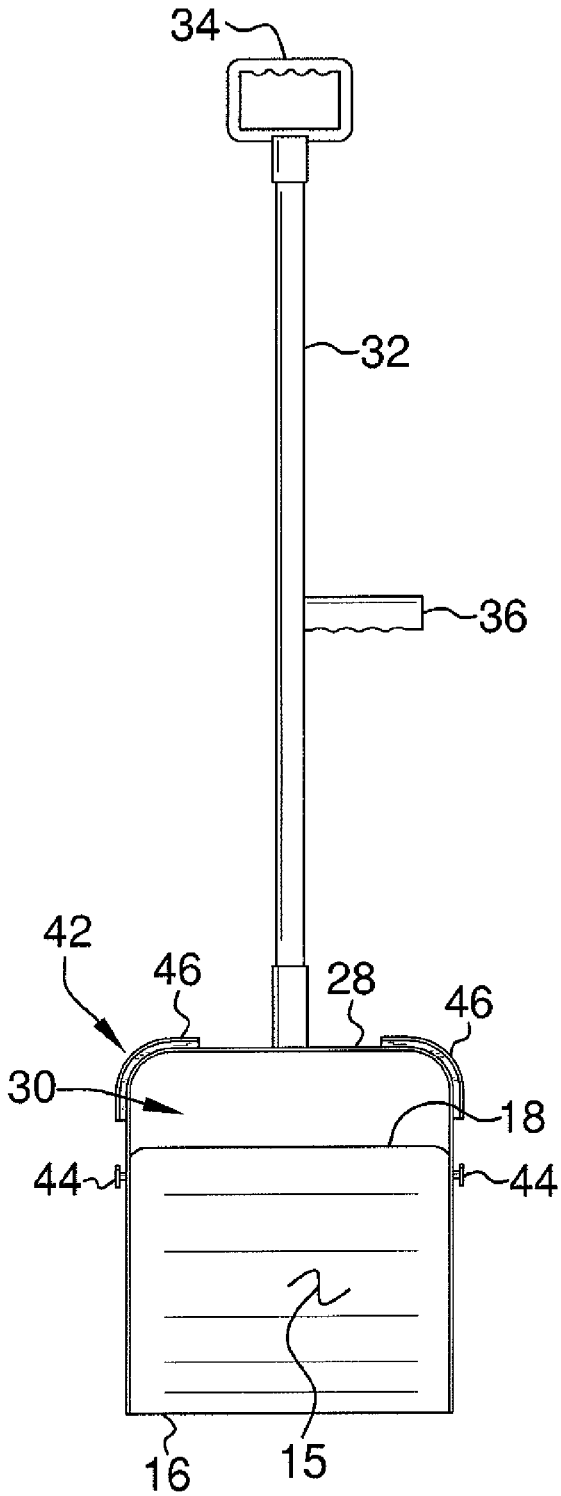
FIG. 3 is a front view of the present invention.
Figure 4:
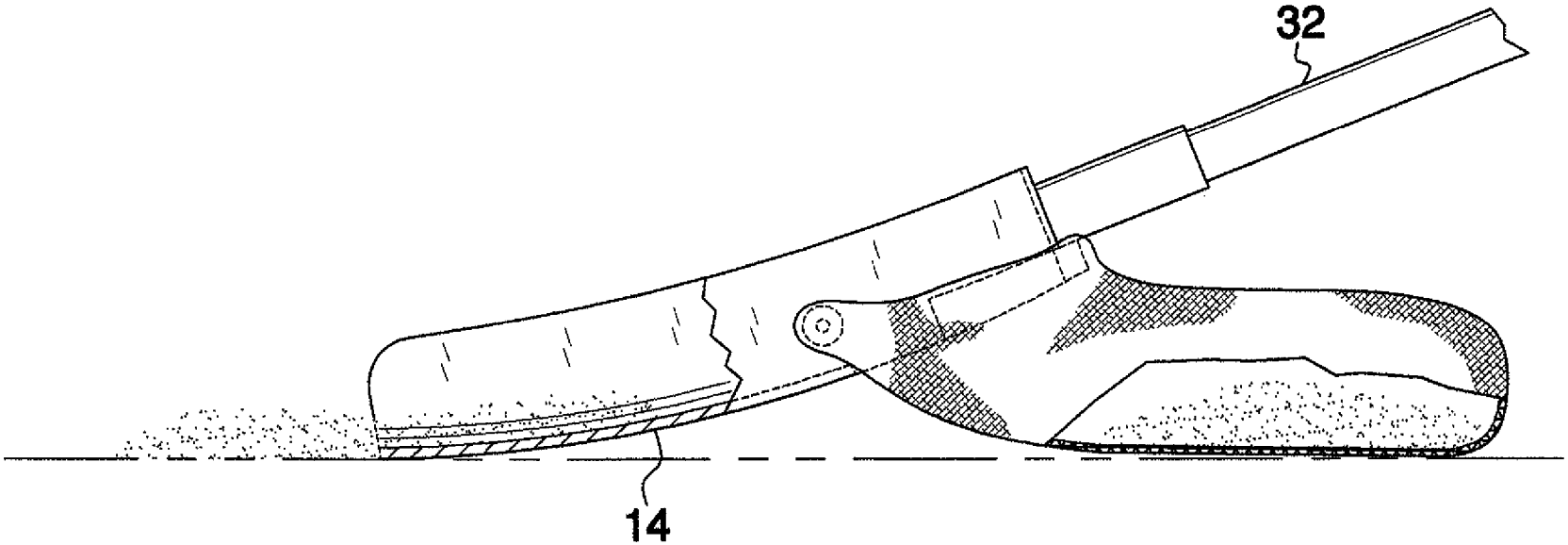
FIG. 4 is a side broken view of the present invention.
Figure 5:
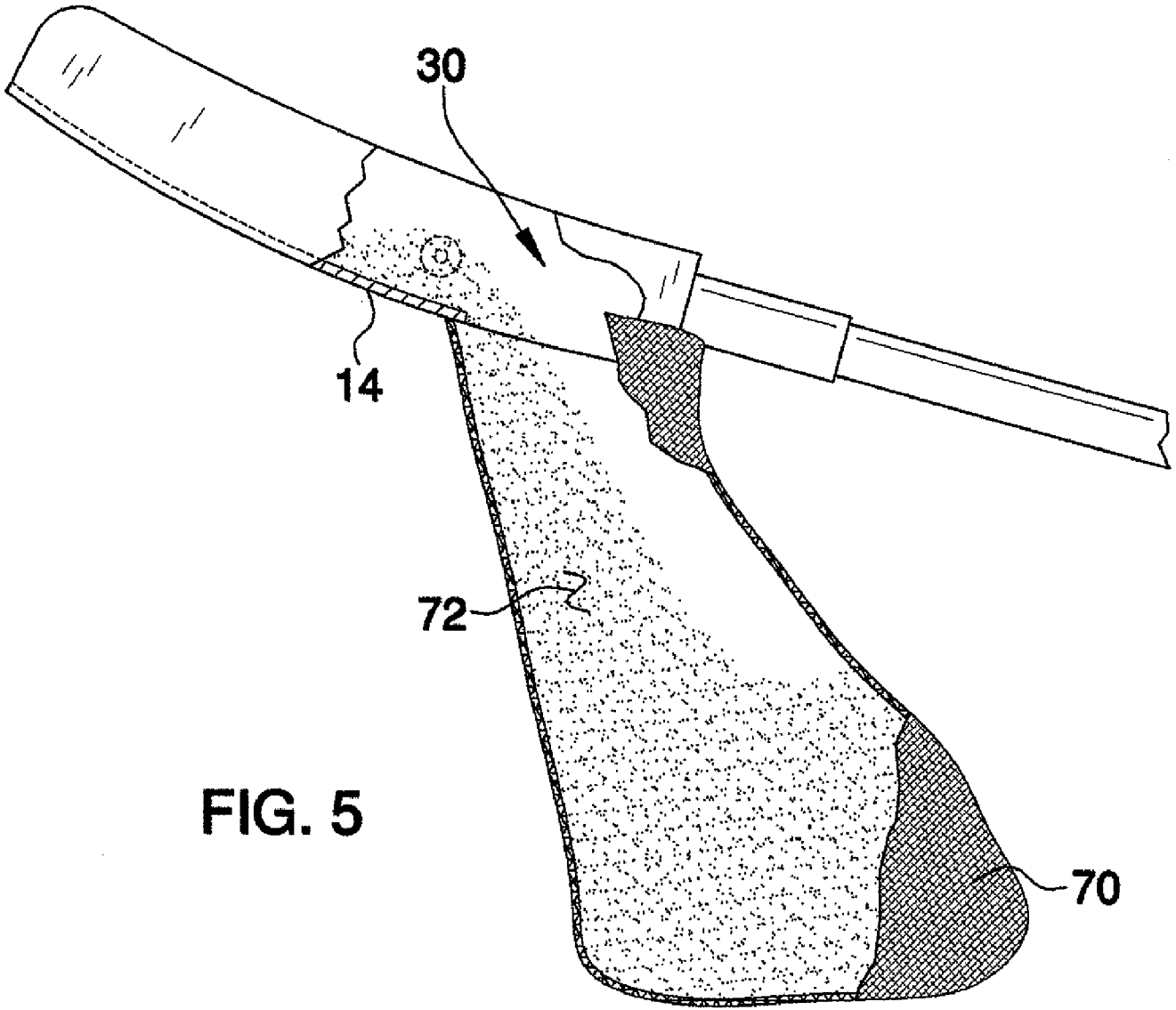
FIG. 5 is a side broken view of the present invention.
Figure 6:
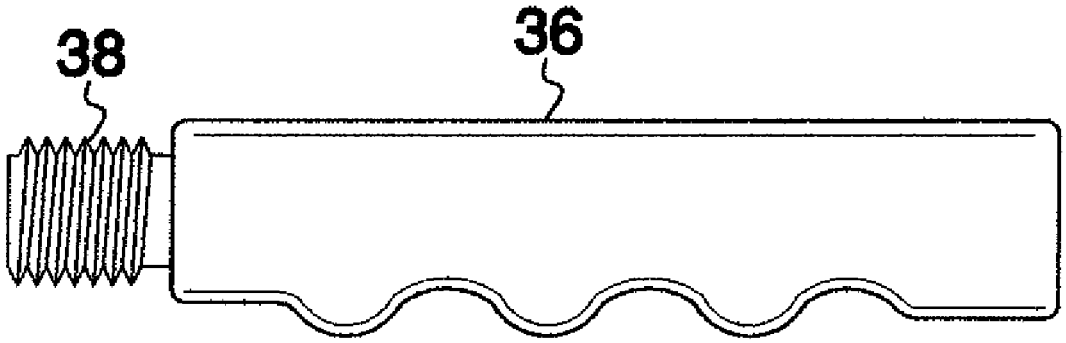
FIG. 6 is a side view of a grip of the present invention.

With reference now to the drawings, and in particular to FIGS. 1 through 6 thereof, a new sandbag filling device embodying the principles and concepts of the present invention and generally designated by the reference numeral 10 will be described.

As best illustrated in FIGS. 1 through 6, the sandbag filling apparatus 10 generally comprises a head portion 12 having a bottom wall 14 that includes a front edge 16, a rear edge 18, a first side edge 20 and a second side edge 22. A first side wall 24 is attached to and extends upwardly from the first side edge 20. A second side wall 26 is attached to and extends upwardly from the second side edge 22. The first 24 and second 26 side walls each extend rearward of the rear edge 18. A rear wall 28 is attached to and extends between distal ends of the first 24 and second 26 side walls with respect to the bottom wall 14. A fill opening 30 is defined between the rear edge 18 and the rear wall 28. A top side 15 of the bottom wall 14 is concavely arcuate from the first side edge 20 to the second side edge 22.

An elongated member 32 is attached to and extends away from the rear wall 28. A handle 34 is attached to the elongated member 32 opposite of the head portion 12. A grip 36 is removably attached to the elongated member 32. The grip 36 has a threaded male coupler 38 attached thereto. The elongated member 32 has a threaded opening 40 extending therethrough and is positioned between the handle 34 and the head portion 12. The male coupler 38 is extended into and threadably coupled to the threaded opening 40. By extending the threaded opening 40 all of the way through the elongated member 32, a user of the apparatus 10 can select to which side of the elongated member 32 the grip 36 is attached.

A retaining apparatus 42 is mounted on the head portion 12 and releasably retains a sandbag 70 in an open position and aligned with the fill opening 30. Sand 72 may be scooped with the bottom wall 14 and dumped into the sandbag 70 through the fill opening 30. The retaining apparatus 42 includes a pair of catches 44. Each of the first 24 and second 26 side walls has an outer surface having one of the catches 44 attached thereto. The catches 44 are positioned between the front edge 16 and the rear edge 18 of the bottom wall 14. The bag 70 is extendable around each of the catches 44. The retaining apparatus 42 further includes a pair of brackets 46. Each of the brackets 46 is attached to the rear wall 28. The brackets 46 are spaced from each other. One of the brackets 46 extends along a portion of the first side wall 24 and the other of the brackets 46 extends along a portion of the second side wall 26. An edge of the bag 70 is positioned on the brackets 46.

In use, the bag 70 is attached to the head portion 12 as described above and as shown in the figures. Bags 70 typically used for sandbags also generally include ties which can be used to aid a person in securing the bag 70 to the head portion 12. Sand 72 is scooped with the head portion 12 and allowed to enter the bag 70 through the fill opening 30.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shovel assembly for filling sandbags, said assembly including:

a head portion having a bottom wall including a front edge, a rear edge, a first side edge and a second side edge, a first side wall being attached to and extending upwardly from said first side edge, a second side wall being attached to and extending upwardly from said second side edge, said first and second side walls extending rearward of said rear edge, a rear wall being attached to and extending between distal ends of said first and second side walls with respect to said bottom wall, a fill opening being defined between said rear edge and said rear wall;

an elongated member being attached to and extending away from said rear wall, a handle being attached to said elongated member opposite of said head portion;

a retaining apparatus being mounted on said head portion and releasably retaining a sandbag in an open position and aligned with said fill opening, wherein sand may be scooped with said bottom wall and dumped into the sandbag through said fill opening, wherein said retaining apparatus includes a pair of catches, each of said first and second side walls having an outer surface having one of said catches attached thereto, said catches being positioned between said front edge and said rear edge of said bottom wall, the bag being extendable around each of said catches;

a pair of brackets, each of said brackets being attached to said rear wall, said brackets being spaced from each other, one of said brackets extending along a portion of said first side wall and the other of said brackets extending along a portion of said second side wall, an edge of the bag being positioned on said brackets; and a grip being removably attached to said elongated member and being positioned between said handle and said head portion.

2. The assembly according to claim 1, wherein a top side of said bottom wall is concavely arcuate from said first side edge to said second side edge.

3. The assembly according to claim 1, wherein said grip has a threaded male coupler attached thereto, said elongated member having a threaded opening extending therethrough and being positioned between said handle and said head portion, said male coupler being extended into and threadably coupled to said threaded opening.

4. A shovel assembly for filling sandbags, said assembly including:

a head portion having a bottom wall including a front edge, a rear edge, a first side edge and a second side edge, a first side wall being attached to and extending upwardly from said first side edge, a second side wall being attached to and extending upwardly from said second side edge, said first and second side walls extending rearward of said rear edge, a rear wall being attached to and extending between distal ends of said first and second side walls with respect to said bottom wall, a fill opening being defined between said rear edge and said rear wall, a top side of said bottom wall being concavely arcuate from said first side edge to said second side edge;

an elongated member being attached to and extending away from said rear wall, a handle being attached to said elongated member opposite of said head portion;

a grip being removably attached to said elongated member, said grip having a threaded male coupler attached thereto, said elongated member having a threaded opening extending therethrough and being positioned between said handle and said head portion, said male coupler being extended into and threadably coupled to said threaded opening; and a retaining apparatus being mounted on said head portion and releasably retaining a sandbag in an open position and aligned with said fill opening, wherein sand may be scooped with said bottom wall and dumped into the sandbag through said fill opening, said retaining apparatus including a pair of catches, each of said first and second side walls having an outer surface having one of said catches attached thereto, said catches being positioned between said front edge and said rear edge of said bottom wall, the bag being extendable around each of said catches, said retaining apparatus further including a pair of brackets, each of said brackets being attached to said rear wall, said brackets being spaced from each other, one of said brackets extending along a portion of said first side wall and the other of said brackets extending along a portion of said second side wall, an edge of the bag being positioned on said brackets.

5. A shovel assembly for filling sandbags, said assembly including:

a head portion having a bottom wall including a front edge, a rear edge, a first side edge and a second side edge, a first side wall being attached to and extending upwardly from said first side edge, a second side wall being attached to and extending upwardly from said second side edge, said first and second side walls extending rearward of said rear edge, a rear wall being attached to and extending between distal ends of said first and second side walls with respect to said bottom wall, a fill opening being defined between said rear edge and said rear wall;

an elongated member being attached to and extending away from said rear wall, a handle being attached to said elongated member opposite of said head portion;

a retaining apparatus being mounted on said head portion and releasably retaining a sandbag in an open position and aligned with said fill opening, wherein sand may be scooped with said bottom wall and dumped into the sandbag through said fill opening, said retaining apparatus includes a pair of catches, each of said first and second side walls having an outer surface having one of said catches attached thereto, said catches being positioned between said front edge and said rear edge of said bottom wall, the bag being extendable around each of said catches; and said retaining apparatus further including a pair of brackets, each of said brackets being attached to said rear wall, said brackets being spaced from each other, one of said brackets extending along a portion of said first side wall and the other of said brackets extending along a portion of said second side wall, an edge of the bag being positioned on said brackets.

6. The assembly according to claim 5, wherein a top side of said bottom wall is concavely arcuate from said first side edge to said second side edge.

* * * * *